United States Patent [19]

Ripley

[11] Patent Number: 4,765,068

[45] Date of Patent: Aug. 23, 1988

[54] HOT ZONE ARRANGEMENT FOR A VACUUM FURNACE

[75] Inventor: Fred W. Ripley, Perkasie, Pa.

[73] Assignee: Vacuum Furnace Systems Corporation, Souderton, Pa.

[21] Appl. No.: 83,269

[22] Filed: Aug. 7, 1987

[51] Int. Cl.[4] ..... F26B 17/10

[52] U.S. Cl. ..... 34/233; 432/66; 432/77

[58] Field of Search ..... 34/233, 63, 66, 225, 34/135, 136, 137; 432/66, 77

[56] References Cited

U.S. PATENT DOCUMENTS 4,395,832 8/1983 Jones et al. ..... 34/233

*Primary Examiner*—Steven E. Warner

*Attorney, Agent, or Firm*—William E. Cleaver

[57] ABSTRACT

The present arrangement is a hot zone structure for a vacuum furnace which includes an endlessly shaped outside wall (e.g. shaped substantially into a circle) preferably made of stainless steel. Disposed next to the inside surface of the outside wall is a layer or layers of heat insulating material means such as graphite felt. Further disposed next to the inside surface of the insulating material means is an inside wall preferably made of graphite. The inside wall defines the chamber of the hot zone structure into which items to be heat treated are placed. Passing through the outside wall, through the layer of heat insulating material, and through the inside wall are many continuous apertures. At the end of each continuous aperture there is located a threaded terminal piece and threaded into each terminal piece is a graphite nozzle. Accordingly there is a plurality of graphite nozzles passing from outside the outside wall of the hot zone structure through into the inside chamber of the hot zone structure. Through the graphite nozzles gasses can be passed from outside of the hot zone structure to the inside thereof for quenching purposes. The graphite nozzles are each removable and do not freeze or bind in the terminal pieces as do nozzles made of other materials.

2 Claims, 1 Drawing Sheet

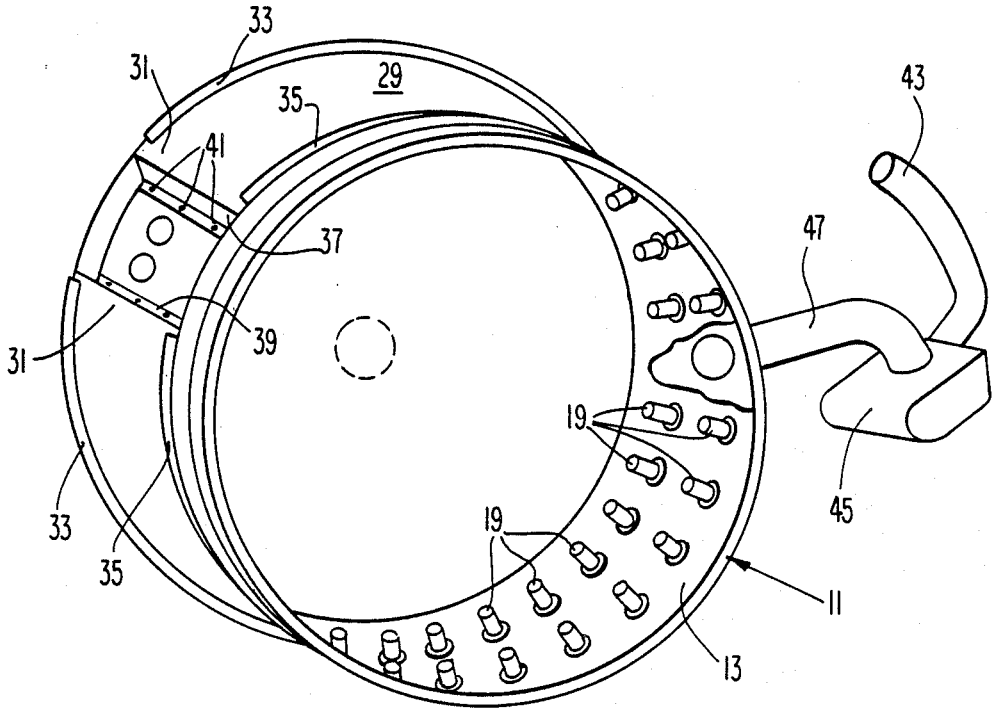

HOT ZONE ARRANGEMENT FOR A VACUUM FURNACE

BACKGROUND OF THE DISCLOSURE

It is a general practice in the design of vacuum furnaces to include heating elements which are located within a structure designated as a hot zone assembly. The hot zone assembly holds the heat generated by the heating elements. It is very often the practice that when the heat treating of a workpiece or workpieces (which has or have been located in the hot zone assembly), is complete, the hot zone assembly is filled with an inert gas, such as nitrogen, and the heat treated pieces are cooled or quenched. As described in U.S. Pat. No. 4,395,832, a plenum can be formed around the outside of the hot zone assembly to assist in the quenching process. The quenching gas is passed into the plenum and through nozzles therefrom which are located between the plenum and the inside section of the hot zone assembly. In the prior art such nozzles have been fabricated from molybdenum since they are subjected to great heat and to repeated hot-cold cycles. I have determined, however, that molybdenum reacts to certain vapors such as nickel chromium vapor. When molybdenum nozzles are subjected to such vapors, the nozzles tend to fuse with the nuts or threaded members, into which they are threaded for support purposes. In addition, certain vapors cause the molybdenum nozzles to shrivel to a certain extent. I have found that: graphite material can be machined into threaded nozzles, if it is carefully done; graphite nozzles can be threaded into the holding pieces (such as nuts welded to the outside wall); and graphite material is not reactive with the vapors which occur in response to elevated temperatures and vacuum conditions and are generally found in a vacuum furnace. Accordingly, the graphite nozzles do not fuse with the holding means and remain removable.

SUMMARY OF THE INVENTION

The present arrangement includes a hot zone which is made up of an outside wall formed substantially in a circle, an inside wall which is also formed substantially into a circle, and a section of heat insulating material located between the outside wall and the inside wall. The inside surface of the inside wall defines the hot zone assembly. In an active segment of the Vacuum Furnace Industry, there are heating elements located within the hot zone assembly and the hot zone assembly serves to retain heat which is generated by the heating elements. The present arrangement includes a plurality of graphite nozzles which pass through the outside wall, through the heat insulation material, and through the inside wall to open into the internal section of the hot zone assembly. The nozzles are fabricated from graphite because: (1) graphite can withstand high temperatures and repeated hot-cold cycles; (2) graphite can be machined to form a threadable nozzle; and (3) graphite does not react with certain vapors that are very often present in a vacuum furnace and hence do not fuse with the holding means into which they are threaded thereby making such graphite nozzles always removable.

The objects and features of the present invention will be better understood from the discussion to follow taken in conjunction with the drawings, wherein.

Figure 1:
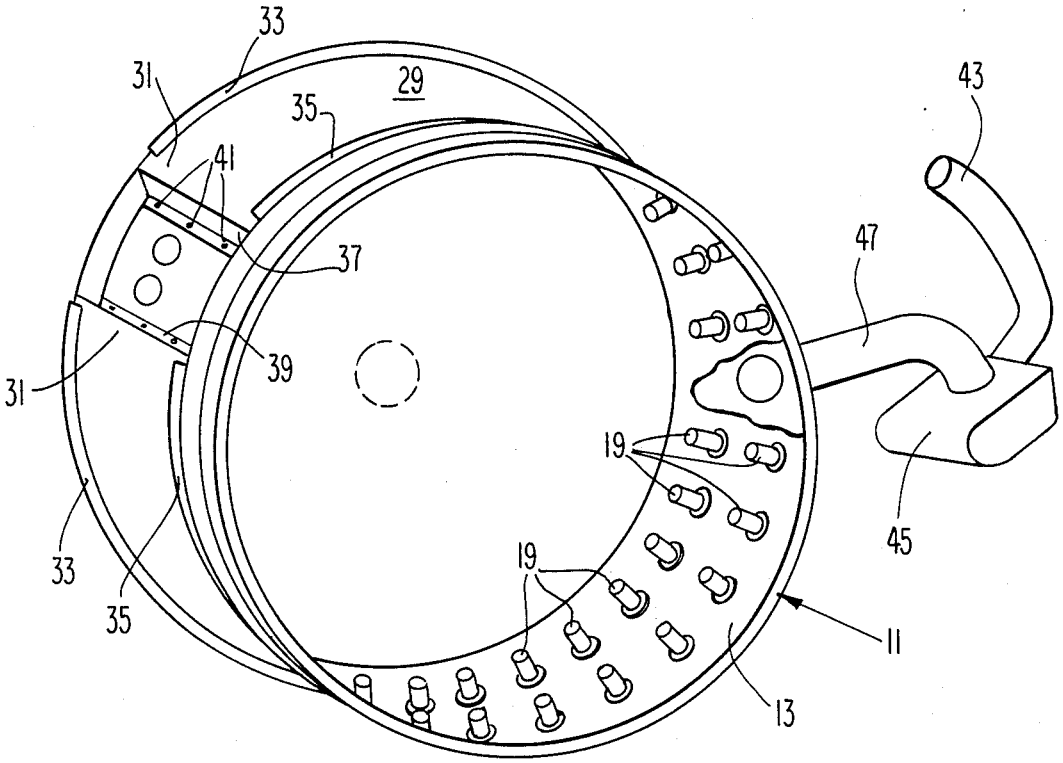
FIG. 1 shows the hot zone with a plurality of nozzles therein.

Consider FIG. 1 which depicts a hot zone structure 11. The hot zone structure 11 is comprised of an outside wall 15, an inside wall 13 and a section of heat insulating material disposed therebetween. In a preferred embodiment the outside wall is fabricated from stainless steel but other suitable materials could be used. In a preferred embodiment the inside wall is fabricated from graphite but the inside wall could be fabricated from stainless steel or molybdenum. The inside wall is directly subjected to very high temperatures and must be able to withstand such high temperatures without distortion or destruction. Graphite is characterized by being able to withstand (with little damage) very high temperatures and repeated cycles of hot and cold temperatures. As can be seen in FIG. 1 the layer of heat insulating material 17 is disposed between the outside wall 15 and the inside wall 13. In a preferred embodiment, the heat insulating material is graphite felt.

As can be further seen in FIG. 1, there is a plurality of nozzles 19 each of which passes through a continuous aperture. Each continuous aperture is formed through the outside wall 15, through the heat insulating layer 17 and through the inside wall 13. The nozzles 19 are fabricated from graphite. As can be better seen in FIG. 2, the graphite nozzle 19 passes through the continuous aperture 21 (shown in phanthom) and is threaded into the terminal nut 23. The terminal nut 23 is welded to the outside wall 15 by the weld 25. The opening 27 in the nozzle 19 is open to the outer side of the outside wall 15. Accordingly, when gasses are impinging against the outside wall 15, (by virtue of a plenum such as plenum 29 shown in FIG. 1), these gasses pass through the openings, such as opening 27, and out internal openings, such as opening 28, to quench workpieces that are present in the hot zone. As explained in U.S. Pat. No. 4,395,832, the plenum 29 includes an outer plate 31 which slides in the space or tracks provided by the side pieces 33 and 35. The outer wall 15 provides the other side of the plenum. The ends of the plenum are sealed off by the end pieces 37 and 39 which are held in place by screws such as the screws 41. When a hot workpiece is no longer to be subjected to heat but indeed should be cooled, inert gas is pumped from the gas reservoir 45, through pipe 47 into the plenum 29, out of the nozzles 19, into the hot zone chamber to cool or quench the workpieces. Such inert gas comes in contact with the hot workpiece and removes heat therefrom. At the same time, the cooling inert gas subjects the nozzles 19 to a dramatic change in temperature and accordingly the nozzles 19 are subjected to repeated cycles of hot and cold temperatures.

Figure 2:
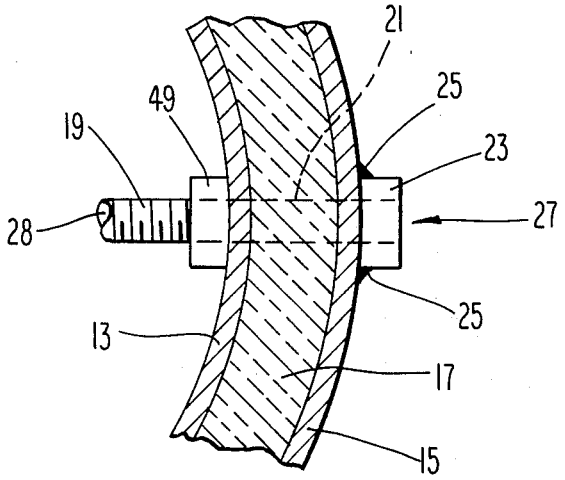
FIG. 2 shows a cross-sectional view of a graphite nozzle passing through a hot zone wall.

Consider FIG. 2 which shows more in detail the graphite nozzle of the arrangement. In FIG. 2 the graphite nozzle 19 is depicted as having been machined to have threads thereon. The threadable graphite nozzle 19 is threaded into the terminal nut 23 so that the graphite nozzle 19 is held in position. Thereafter a nut 49 is threaded over the front end of the graphite nozzle 19 and is threaded up tight against the inside wall 13. After such an assembly the graphite nozzle 19 is held tightly in position so that it takes on the role of the nozzle shown in FIG. 1. As was mentioned in the earlier discussion, nozzles in the prior art were made from molybdenum or stainless steel. While molybdenum can stand great temperatures as can stainless steel, both of these materials are subject to deterioration, distortion and destruction because of certain vapors such as nickel chromium vapor which are generated in vacuum furnaces. I have found that if the nozzles are made of graphite such as graphite nozzle 19 that the vapors do not in any way affect the nozzle. To say it another way, the graphite of which the nozzle 19 is made is non-reactive to certain gas vapors which are very often found in a vacuum furnace hot zone chamber. Accordingly, in the event that the graphite nozzle 19 does get damaged for any number of reasons, the nut 49 can be simply removed because it does not freeze on the front end of the nozzle and thereafter the graphite nozzle itself can be removed from the terminal nut 23. In this way the effort to repair the nozzles which are internal to the hot zone structure is a relatively simple process.

I claim:

1. A vacuum furnace hot zone comprising in combination: outside wall means having at least one aperture therein; inside wall means having at least one aperture therein and having an inside surface disposed to define the inside chamber of a hot zone of a vacuum furnance; heat insulating material menas disposed between said outside wall means and said inside wall means and having at least one aperture therein; said one aperture in said outside wall means disposed to be in alignment with said at least one aperture in said heat insulating material means and said at least one aperture in said heat insulating material means disposed to be in alignment with said at least one aperture in said inside wall means to form a continuous aperture through said outside wall means, said heat insulation material means and said inside wall means; first fastening means disposed at the end of said continuous aperture and secured to said outside wall; and graphite nozzle means disposed in said continuous aperture and securely fastened into said first fastening means for permitting gasses to pass from the outside of said outside wall means through said heat insulating material means and through said inside wall means to the hot zone of a vacuum furnace.

2. A vacuum furnace hot zone according to claim 1 wherein there is further included a second fastening means threaded over said graphite nozzle to come to rest against said inside surface of said inside wall means to further securely fasten said graphite nozzle in a fixed position.

* * * * *